United States Patent [19]

Polukhin et al.

[11] 4,237,714

[45] Dec. 9, 1980

[54] STAND OF COLD TUBE-ROLLING MILL

[76] Inventors: Petr I. Polukhin, ulitsa Dmitria Ulyanova, 4, kv. 37; Ivan N. Potapov, Leninsky prospekt, 57/1, kv. 33; Ivan P. Gremyakov, ulitsa Profsojuznaya, 95, korpus 1, kv. 411, all of Moscow; German D. Styrkin, ulitsa Klimova, 22/11, kv. 29, Noginsk Moskovskoi oblasti; Mikhail A. Bitny, Kommunistichesky prospekt, 89, kv. 17, Alma-Ata; Igor M. Raushenbakh, 5 mikroraion, 33, kv. 33, Alma-Ata; Petr A. Rodionov, ulitsa Zhubanova, 5, kv. 60, Alma-Ata, all of U.S.S.R.

[21] Appl. No.: 950,448

[22] Filed: Oct. 11, 1978

[30] Foreign Application Priority Data

Oct. 19, 1977 [SU] U.S.S.R. ..... 2529718

[51] Int. Cl.[3] ..... B21B 13/12; B21B 29/00; B21B 31/18

[52] U.S. Cl. ..... 72/242; 72/247

[58] Field of Search ..... 72/237, 241, 247, 238, 72/242, 244, 208, 214, 243

[56] References Cited

U.S. PATENT DOCUMENTS

| | | | |
|---|---|---|---|
| 1,614,422 | 1/1927 | Coe | 72/243 X |
| 1,708,185 | 4/1929 | Mattei | 72/242 X |
| 2,085,449 | 6/1937 | Rohn | 72/242 X |
| 2,327,706 | 8/1943 | Halstead | 72/237 X |
| 3,001,424 | 9/1961 | Pickles | 72/237 |
| 3,308,643 | 3/1967 | Fahrenholz et al. | 72/238 |
| 3,368,381 | 2/1968 | Frohling et al. | 72/243 |
| 3,580,034 | 5/1971 | Wilson | 72/237 |
| 3,587,278 | 6/1971 | Kracht | 72/237 |

FOREIGN PATENT DOCUMENTS

| | | | |
|---|---|---|---|
| 365090 | 12/1977 | U.S.S.R. | 72/214 |

*Primary Examiner*—Milton S. Mehr
*Attorney, Agent, or Firm*—Fleit & Jacobson

[57] ABSTRACT

A stand of a cold tube-rolling mill is formed by a housing and work rolls. Mounted in pairs on the housing are uprights arranged opposite to the axis of rolling. The work rolls are mounted one above the other in the bearing supports between pairs of lower and upper backup rolls mounted in corresponding bearing chocks. The upper bearing chocks are adapted for vertical setup motions. The stand has a device for ensuring positive contact of the work rolls. The device is a linkage mechanism for each bearing chock of the upper backup rolls that links kinematically the bearing chock with an independent power drive ensuring its vertical setup motion.

3 Claims, 7 Drawing Figures

STAND OF COLD TUBE-ROLLING MILL

FIELD OF INVENTION

The present invention relates to tube production and more particularly it relates to the designs of stands utilized in cold tube-rolling mills since the stand is one of the major and vital mill units on which the quality of the rolled tubes depends.

At present, due to a common practice of rolling thin-walled tubes and tubes from hard-to-work metals and alloys a strong emphasis is laid on the rigidity of stands and the accuracy of installation of radially preloaded work rolls.

One of the predominant factors affecting the accuracy of rolled tubes, particularly in the stands with multiple-groove work rolls, is uniform radial loading of the work rolls throughout the length of their contact.

BACKGROUND OF THE INVENTION

Known in the prior art are the stands of a cold tube-rolling mill comprising a housing with two pairs of uprights located between which are the work rolls with bearing supports installed on both sides of the work rolls, and between each pair of circular passes and interconnected in pairs with a certain prestressing by tie bolts (Pat. No. 1,287,541, Federal Republic of Germany). In such stands the radial rolling forces are transmitted by the bearing supports to the tie bolts, while the provision of additional bearing supports located between each pair of passes and likewise held together with bolts with a certain prestressing counters the sagging of the rolls.

In these stands the prestressing of the work rolls is changed and controlled by tightening the bolts; this calls for stopping the mill and involves a considerable waste of time. Besides, the diameter of the bearing supports taking the rolling forces in this design depends on the diameter of the work roll. The rolling of extra-thin-walled tubes and small-diameter tubes from hard-to-work metals and alloys under advanced technological conditions calls for the use of sets of small-diameter work rolls (100–200 mm) in order to rule out the effect of flexible flattening of the work rolls on the thickness of the tube wall and the accuracy of the rolled tubes and to reduce the contact zone between the metal of the tube being rolled and the work rolls since a large contact zone results in considerable heating of the tube billet and tool (particularly the plug and the internal layers of metal of the tube billet due to an insufficient abstraction of heat by the cooling fluid) which intensifies the sticking of metal to the tool, impairs the quality of the rolled tubes and aggravates the tool wear. The life of the bearing supports of the work rolls is short due to the considerable radial forces arising in the rolling of tubes from hard-to-work materials.

At present one can witness certain tendencies towards perfecting the stands of the cold tube-rolling mills by introducing backup rolls which take up all the rolling forces.

Such a stand of a cold tube-rolling mill comprises a housing with uprights arranged in pairs opposite to the axis of rolling, work rolls installed one above the other in bearing supports between the lower and upper backup rolls mounted in the corresponding bearing chocks adapted for vertical setup motion, and a device for a positive contact of the work rolls, said device having the form of a common cover articulated to the uprights by axles and wedge mechanisms for its vertical setup motion and provided with a stop in the form of a bearing bar which is in positive contact with the upper backup roll (Author's Certificate Int Cl. B21B 21/00 No. 365090, USSR).

In this stand of the cold tube-rolling mill the radial rolling forces are taken by the backup rolls while the provision of wedge mechanisms for the vertical setup motion of the cover makes it possible to install the work rolls with a certain prestressing which is accomplished as follows. The wedge mechanisms move the cover vertically down whereas the force is transmitted by the bearing bar and the upper backup roll to the work rolls, the lower backup roll and, via the lower bearing bar and the base to the housing uprights.

However, the layout of the device for the positive contact of the work rolls in the form of a common cover and wedge mechanisms which articulate said cover with the uprights hinders the process of adjustment and denies the possibility of prompt and accurate setting of the preliminary radial force of clamping of the work rolls because the vertical position of the cover is set with the aid of separately installed wedge mechanisms. Moreover, in this stand it is impossible to change the prestressing of the work rolls in the course of mill operation. For fitting this stand with sets of work rolls of a different diameter it is necessary to replace the backup rolls, gearing elements and bearing bars which also involves considerable waste of time and the provision of additional structural elements.

An object of the present invention resides in providing a stand of a cold tube-rolling mill which would ensure uniform clamping of the work rolls by the backup rolls with the required force throughout the length of their contact.

Another object of the present invention resides in providing a stand of a cold tube-rolling mill which would permit changing the prestressing of the work rolls in the course of operation.

And still another object of the present invention resides in providing a stand of a cold tube-rolling mill which would permit installation of sets of work rolls of different diameters for rolling tubes of different gauges from hard-to-work materials.

The essence of the present invention lies in providing a stand of a cold tube-rolling mill, consisting of a housing with pairs of uprights arranged opposite to the axis of rolling, of work rolls installed one above the other in bearing supports between pairs of lower and upper backup rolls mounted in corresponding bearing chocks of which the upper ones are adapted for vertical setup motions and a device for a positive contact of the work rolls wherein, according to the invention, the device for the positive contact of the work rolls has a leverage or linkage mechanism for each bearing chock of the upper backup rolls, said linkage mechanism linking kinematically the bearing chock with an independent power drive for ensuring the vertical setup motions of said chock.

It is practicable that the linkage mechanism should be made in the form of a beam, one end of which is articulated with one upright of the pair, has a stop which is in positive contact with the bearing chock of the upper backup rolls, a rod and an eccentric shaft, said elements linking kinematically the other end of the beam with the other upright of the pair and with a movable member of an independent power drive.

Such technical solutions permit fitting the stand with sets of work rolls of different diameters without replacing the backup rolls and ensure uniform clamping of the work rolls by the backup rolls with the required force along the length of the contact by means of the setup motion of the upper backup rolls through their bearing chocks with the aid of the device ensuring the positive contact of the work rolls.

It is practicable that the bearing support of each work roll should be made in the form of a spherical joint installed in the support body with a clearance intended to make up for the errors occurring during the setup motions of the bearing chocks of the backup rolls.

Moreover, such technical solutions will improve the accuracy of setting of the work rolls, and the rigidity of the system: work rolls—bearing chocks—uprights—stand housing and thus will raise the accuracy of the thin-walled tubes and of the tubes from hard-to-work materials rolled in this stand.

BRIEF DESCRIPTION OF THE DRAWINGS

The invention will now be described in detail by way of example of a two-line embodiment for the cold tube-rolling mill with a stationary stand, with reference to the accompanying drawings (in which).

DETAILED DESCRIPTION OF THE INVENTION

Figure 3:
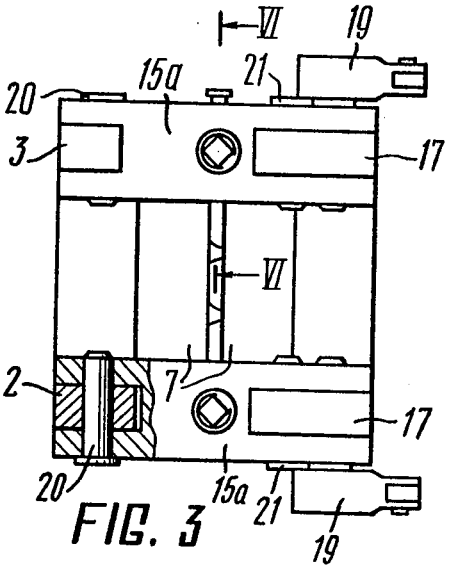
FIG. 3 is a top view of the mill stand according to the invention.
Figure 4:
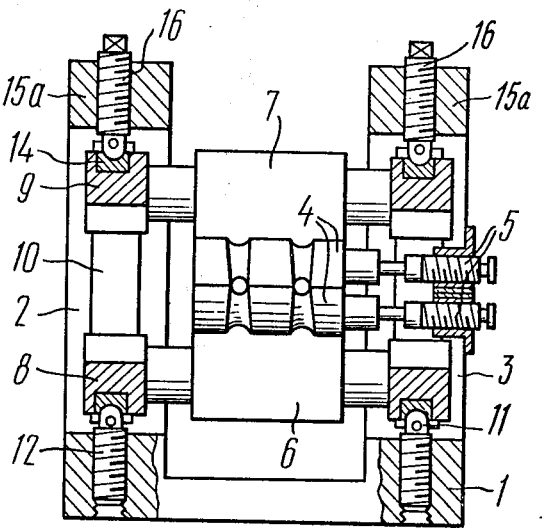
FIG. 4 is a section of the stand of a cold tube-rolling mill taken along a vertical plane passing through the axes of the work rolls, line IV—IV in FIG. 1.

The stand of a cold tube-rolling mill according to the invention comprises a housing 1 (FIGS. 1, 2) with two pairs of uprights 2, 3 arranged opposite to the axis of rolling. Work rolls 4 are installed one above the other in bearing supports 5 between the pair of the lower backup rolls 6 and the pair of the upper backup rolls 7 (FIG. 3) mounted, respectively, in the bearing chocks 8, 9 (FIG. 1) which are capable of performing adjusting and setup motions along vertical guides 10 secured on the uprights 2 and 3. The bearing chocks 8 of the lower backup rolls 6 are linked with the housing 1 through the spherical supports 11 (FIG. 4) of the setup screws 12.

Figure 1:
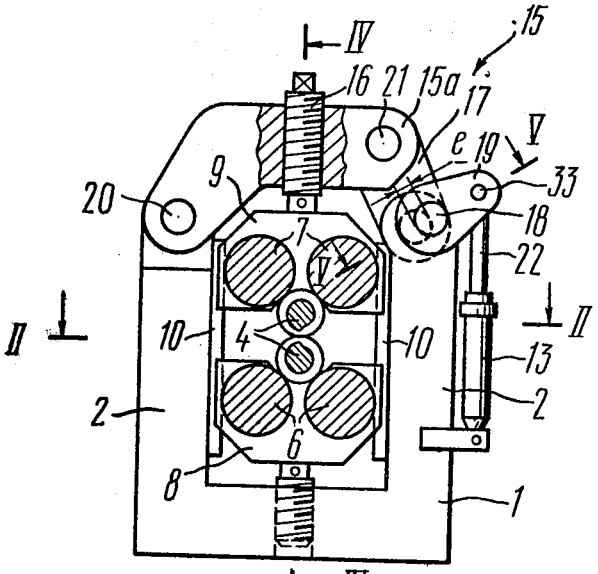
FIG. 1 is a general view, partly sectionalized, of the stand of a cold tube-rolling mill according to the invention, viewed from the servicing side.
Figure 2:
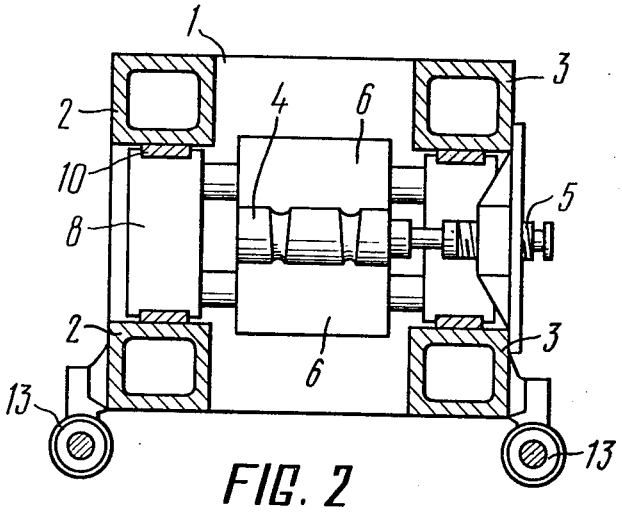
FIG. 2 is a section through the stand of a cold tube-rolling mill along the horizontal plane passing through the axis of rolling, line II—II in FIG. 1, turned through 90°.

Each bearing chock 9 of the upper backup rolls 7 is provided with an independent power drive, for example a setting-up hydraulic cylinder 13 (FIG. 1) with which it is linked by a pressure transmitter 14 (FIG. 4) and a leverage or linkage mechanism 15 (FIG. 1). The linkage mechanism 15 comprises a beam 15*a* with a stop 16, a rod 17 and an eccentric shaft 18 with a lever 19. The stop 16 is of the screw type. One end of each beam 15*a* (FIG. 3) is articulated by an axle 20 with one of the uprights 2, 3 (FIG. 1) of the pair while its other end is linked kinematically with the other upright 2, 3 of the pair and with the movable member of the independent power drive. This kinematic linkage is effected with the aid of an axle 21, rod 17, eccentric shaft 18 with eccentricity "e" and lever 19 and with the aid of a movable member, e.g. rod 22 of the hydraulic cylinder 13. (FIG. 1).

Figure 5:
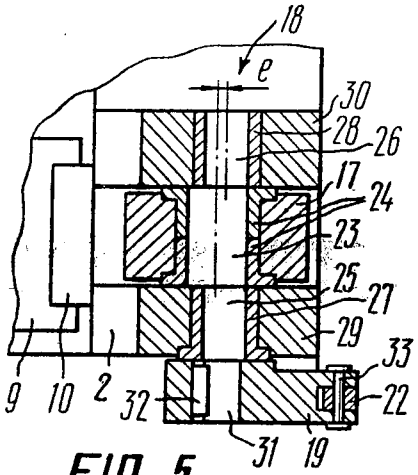
FIG. 5 is a section taken along the plane passing through the axis of the eccentric shaft, line V—V in FIG. 1.

The eccentric shaft 18, whose neck 23 (FIG. 5) carries a rod 17 with bearing bushes 24, is installed on its journals 25, 26 in bearing bushes 27, 28 in the lugs 29, 30 of the uprights 2, 3 (FIG. 5 shows the upright 2). The end 31 of the eccentric shaft 18 carries a lever 19 secured by a key 32 and articulated by the axle 33 with the rod 22 of the hydraulic cylinder 13 (FIG. 1).

The bearing support 5 (FIG. 4) of each work roll 4 has the form of a joint consisting of shaped surfaces 35 installed on the neck 34 (FIG. 6) of the work roll 4. Each shaped surface 35 is mounted on bearings 36 and in a supporting bushing 37. The joint is installed with a clearance "δ" in the hole of the body 44 and held against axial displacement by a nut 38 with a retainer 39 at one side while at the other side it is held by a nut 42 with a retainer 43 through spacer bushings 40 with a spring 41 installed between them for taking up the clearance in the bearings 36.

Figure 6:
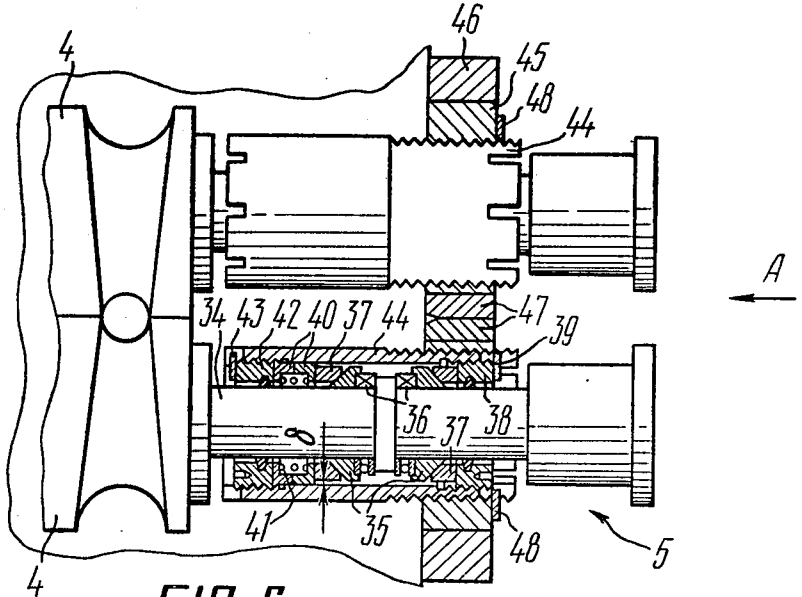
FIG. 6 is a local section along the vertical plane passing through the axis of the bearing supports of the work rolls, line VI—VI in FIG. 3, turned through 90° and enlarged.

The body 44 of the bearing support 5 has the form of a bushing with an external thread for axial adjustment of the work roll 4. Each bushing is connected by a screw joint with a holder 45 installed in guides 46 (FIG. 7) through replaceable shims, gaskets or the like designated. The body 44 is held against turning by a retainer 48 (FIG. 6).

Figure 7:
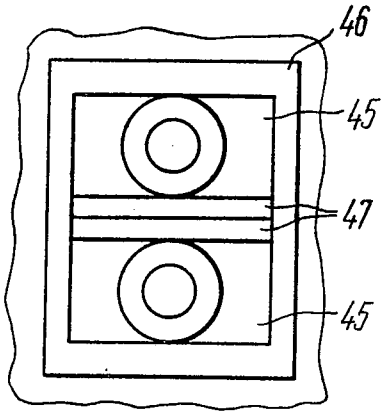
FIG. 7 shows the work rolls from the drive side, View A in FIG. 6.

The stand is set up as follows. A set of work rolls 4 of the required diameter is placed into the stand. Shims 47 of the required thickness are placed between the holders 45 (FIG. 7). The diameter of the work rolls 4 (FIG. 6) depends on the diameter and wall thickness of the tube to be rolled and on the mechanical properties of its material. The smaller the tube diameter, the smaller should be the diameter of the work rolls 4.

Using set-up screws 12 (FIG. 4) the bearing chocks 8 of the lower backup rolls 6 are moved to align the axes of the grooves of the work rolls passes with the axes of rolling in a vertical plane. Then the holders 45 (FIG. 7) are secured in the guides 46.

The axial setting up of the work rolls 4 (FIG. 6) consists in aligning the grooves of the passes of the upper and lower work rolls 4 with the axes of rolling. It is done by turning the external-thread bushings in the holders 45. Upon completion of adjustments these bushings are locked by retainers 48 against possible turning. The bearing chocks 9 (FIG. 1) with the upper backup rolls 7 are moved for preliminary clamping of the work rolls 4 in the backup rolls 6, 7. The uniform clamping of the work rolls 4 by the backup rolls 6, 7 with the required force along the entire length of the contact is carried out by means of the hydraulic cylinders 13; for this purpose the eccentric shaft 18 is turned by the lever 19, the eccentricity "ρ" of said shaft being selected to suit the maximum force of preliminary clamping of the work rolls 4 by the backup rolls 6, 7, taking in account the yielding capacity of the elements of the stand of the cold tube-rolling mill. Turning in the bushes 27, 28 (FIG. 5), the eccentric shaft 18 turns the beam 15*a* (FIG. 1) relative to the axle 20 through the rod 17 installed on its neck 23, and the axle 21. The force is transmitted through the screw stops 16, pressure transmitters 14 and bearing chocks 9 with the upper backup rolls 7 to the work rolls 4 and, through the lower backup rolls 6, bearing chocks 8 and setting-up screws 12, to the housing 1.

The value of preliminary clamping, i.e. prestressing of the stand is determined on the basis of the mechanical properties of the material and the required dimensional accuracy of the tubes to be rolled.

Continuous control of stand prestressing is conducted with the aid of pressure transmitters 14.

The errors in the vertical setup of the work rolls 4 bear no influence on the accuracy and quality of the rolled tubes because the bearing support 5 (FIG. 4) of each work roll 4 in the form of a spherical joint with a clearance "δ", installed in the holder 45 (FIG. 6) compensates fully for these errors.

Thus, the claimed stand of a cold tube-rolling mill can be fitted with sets of work rolls 4 of the required diameter, said rolls can be set-up quickly, the setting-up errors are simultaneously compensated and the rolls are clamped uniformly with the required force throughout the length of contact so that this stand is adapted for rolling thin-walled tubes from various materials including the hard-to-work ones, under the advanced technological conditions.

What is claimed is:

1. A stand of a cold tube-rolling mill comprising:

a housing;

uprights arranged in pairs on said housing on opposite sides of an axis of rolling;

upper and lower bearing chocks installed between said uprights;

means for independently vertically adjusting said upper and said lower bearing chocks;

pairs of upper and lower backup rolls mounted in corresponding bearing chocks;

bearing supports positioned in said uprights;

work rolls installed one above the other in said bearing supports between said pairs of upper and lower backup rolls;

a device for the positive contact of said backup rolls with said work rolls;

independent power drive means for controlling vertical setup motions of said bearing chocks of said upper backup rolls and for controlling forces between the work rolls during a rolling operation;

said device for the positive contact of said backup rolls with the work rolls including a linking mechanism kinematically linking each of said upper bearing chocks with said independent power drive means.

2. A stand of a cold tube-rolling mill according to claim 1, wherein said linking mechanism includes:

a rod;

an eccentric shaft;

a beam with a stop brought into positive contact with said bearing chock of said upper rolls, one end of said beam being articulated to one of said uprights of a pair while the other end is linked kinematically by said rod and said eccentric shaft with the other said upright of the pair and with a movable member of said independent power drive means.

3. A stand of a cold tube-rolling mill according to claim 1 or claim 2, wherein said bearing support of each of said work rolls is made in the form of a joint having shaped surfaces, the joint being installed in the body of said support with a clearance for making up for the errors occurring during the setup motions of said bearing chocks of said backup rolls.

* * * * *